United States Patent [19]

Warnke et al.

[11] 4,057,006

[45] Nov. 8, 1977

[54] VALVE PLATE ARRANGEMENT FOR HYDROSTATIC PISTON MACHINES

[75] Inventors: Hans Warnke, Herne; Werner Böer, Castrop-Rauxel, both of Germany

[73] Assignee: Klockner-Werke AG, Duisburg, Germany

[21] Appl. No.: 671,611

[22] Filed: Mar. 29, 1976

[30] Foreign Application Priority Data

May 9, 1975 Germany ..... 2520695

[51] Int. Cl.[2] ..... F01B 3/00; F01B 13/04

[52] U.S. Cl. ..... 91/487; 91/489

[58] Field of Search ..... 91/486, 487, 489, 499

[56] References Cited

U.S. PATENT DOCUMENTS

| | | | |
|---|---|---|---|
| 3,082,696 | 3/1963 | Henrichsen | 91/487 |
| 3,702,576 | 11/1972 | Pruvot | 91/487 |
| 3,803,984 | 4/1974 | Lachner | 91/487 |

FOREIGN PATENT DOCUMENTS

| | | | |
|---|---|---|---|
| 1,958,160 | 6/1970 | Germany | 91/487 |

*Primary Examiner*—John J. Vrablik
*Attorney, Agent, or Firm*—Michael J. Striker

[57] ABSTRACT

An axial piston machine of the swash plate type includes a valve plate provided in a front face thereof with control openings which communicate at opposite ends through bores with the rear face of the valve plate. A plurality of shallow pockets, respectively forming hydrostatic bearings, are also provided in said front face, which communicate through connecting bores respectively with throttle bores, which in turn communicate at inner ends with respective control openings, and in which spring loaded throttle pins are arranged with small clearance for oscillating movement.

7 Claims, 4 Drawing Figures

VALVE PLATE ARRANGEMENT FOR HYDROSTATIC PISTON MACHINES

BACKGROUND OF THE INVENTION

The present invention relates to a valve plate or control disc for an axial piston machine of the swash plate type, which in its control surface is provided with control openings and bearing pockets for hydrostatically mounting the valve plate on the rotating cylinder drum of the axial piston machine, in which the control openings communicate with the bearing pockets through throttle passages.

A valve plate of the above-described type is disclosed in the German Pat. No. 2,157,704 and the corresponding U.S. Pat. No. 3,803,984. The basic feature of the valve plate disclosed in these patents is to permit the compensation of additional forces, occurring in the gap between adjacent faces of the valve plate and the cylinder drum depending on the relative position of the two elements with each other, by means of hydrostatic bearings with in series connected throttles. In this known construction the hydrostatic thrust bearings are formed as shallow grooves arranged in pairs in circumferential direction of the valve plate with small radial distance from each other in the two dead center regions and connected by channels to annular gaps formed between pressure cylinder bores, extending from the rear face of the valve plate into the latter, and pistons respectively inserted therein. The connection between the control openings and the bearing pockets is constructed in such a manner that a bore branches off from a control opening and leads to one cylinder bore, eventually by a further bore connected to the first-mentioned one. An annular groove is provided in the cylinder bore spaced from the mouth opening of the bore. Furthermore, the piston is arranged in the cylinder bore in such a manner that the piston can perform oscillating movements. In this way it is usually possible to prevent that foreign particles will settle between the pressure piston and the cylinder in the location between the mouth of the bore and the annular groove.

A further bore leads in tangential direction from the annular groove to the periphery of the valve plate or control disc. The bore is closed at the periphery by a plug or the like. An additional bore, normal to the first-mentioned one, branches off from the latter and leads into the respective bearing pocket for maintaining a hydrostatic bearing. Four such connections are provided in the known valve plate.

SUMMARY OF THE INVENTION

It is an object of the present invention to provide a valve plate of the above-mentioned kind in which a reliable hydrostatic bearing arrangement of the control surface of an axial piston machine of the swash plate type is assured.

With these and other objects in view, which will become apparent as the description proceeds, the present invention basically is directed to a valve plate for an axial piston machine of the swash plate type in which a pair of control openings with opposite ends are provided in the front face of the valve plate, and in which a plurality of bores through the valve plate respectively provide communication between the opposite ends of the control openings with the rear face of the valve plate, in which a plurality of shallow pockets, forming hydrostatic bearings, are provided in the front face, which communicate through connecting bores with throttle bores having outer ends at the periphery of the valve plate and communicating at inner ends with a respective control opening, and in which spring biased throttle pins are arranged with small clearance for oscillatory movement.

In this way a valve plate of the abovementioned kind is obtained which fully satisfies the abovementioned objects. By means of the throttle pins arranged in the throttle bores it is possible to reduce the free cross-section of the passages leading to the bearing pockets so that, at one hand, only a very small amount of liquid will flow to the bearing pockets and, on the other hand, the pressure of such liquid will be throttled down to the desired value. While due to the narrow cross-section of the flow passage the danger exists that such crosssection is clogged by foreign particles, this danger is avoided by maintaining the throttle pins in the throttle bores in oscillating movement during all operating conditions, by the use of hydraulic, elastic and mass forces.

According to a further feature of the present invention the throttle pins are spring loaded in opposition to the fluid pressure acting thereon, whereby the springs may abut against closure means closing the outer ends of the radial bores. On the other hand, the springs may also abut against one end of an additional pin located in the throttle bore which abuts with the other end thereof against a wall of a housing.

The spring characteristic of the aforementioned springs is preferably chosen in such a manner that the throttle pins are maintained oscillating during the operation by the varying fluid pressure acting on the throttle pins. Preferably, the dimensions of the throttle pins and the throttle bores is chosen in such a manner that the pressure loss occurring along the throttle pins is about 50% of the operating pressure occurring at any time at an optimal height of a gap at the front face of the valve plate. The throttle bores preferably extend in radial direction. If two control openings are provided in the valve plate, then two throttle bores with coordinated connecting bores and bearing pockets are provided for each of the control openings.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
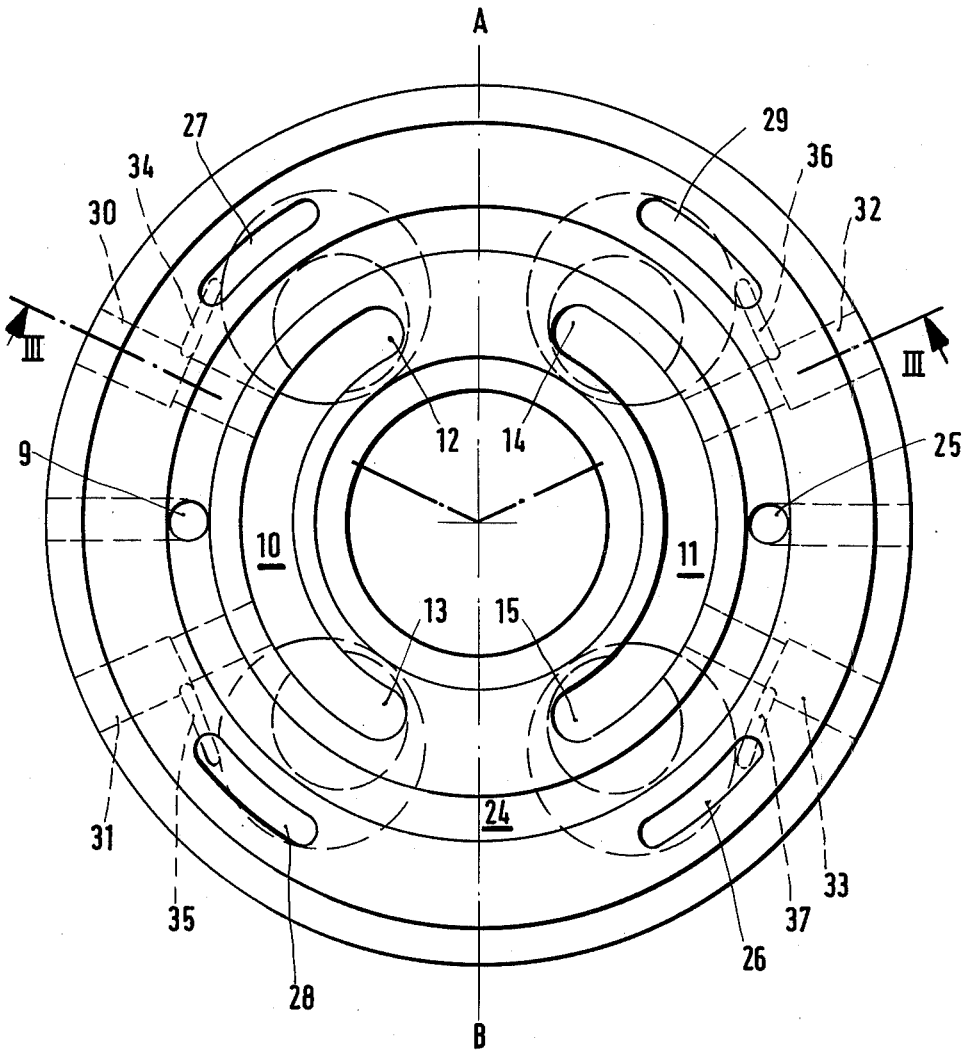
FIG. 1 is a top view on the control surface of the valve plate.
Figure 2:
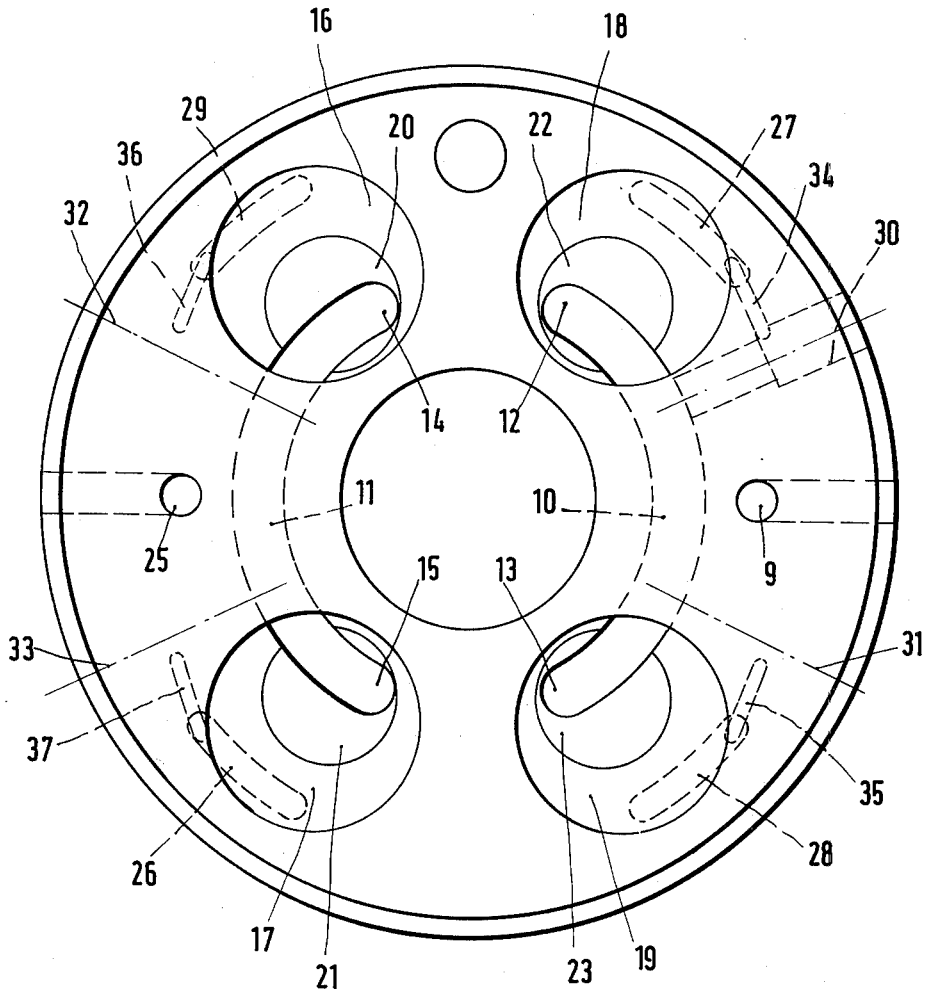
FIG. 2 is a view on the rear face of the valve plate.

Referring now to the drawing, it will be seen that the valve plate according to the present invention, for axial piston machines of the swash plate type, is provided in the end face thereof, adapted to be directed toward a corresponding end face of the non-illustrated cylinder barrel, with a pair of substantially kidney-shaped control openings 10 and 11 which are arranged mirror symmetrically with regard to the dead-center plane A–B. The opposite ends 12 and 13, respectively 14 and 15 of the control openings 10 and 11 communicate respectively with axial bores 18, 19 and 16, 17, as most clearly shown in FIG. 2. The bores 16 – 19 are respectively provided at the ends thereof at which they communicate with the control openings with rounded portions 20 – 23 so as to improve the flow conditions of the fluid passing therethrough. These rounded portions will provide an advantageous transition between the bores 16 – 19 and the control openings 10, 11.

An annular groove 24 located radially outwardly of the control openings 10 and 11 is provided in the front face of the valve plate. The annular groove 24 is connected by radial bores 9 and 25 with the peripheral surface of the valve plate so as to maintain atmospheric pressure in the annular groove 24. Bearing pockets 26 – 29 are provided in the front face of the valve plate located radially outwardly of the annular groove 24 and circumferentially spaced from each other. The bearing pockets 26 – 29 consist of shallow recesses and serve for hydrostatically mounting the valve plate on the mentioned cylinder drum.

The valve plate is further provided with a plurality of radial bores 30, 31, 32 and 33 which communicate at outer ends with the periphery of the valve plate and with their inner ends with the control openings 10 and 11. In the illustrated embodiment in which two control openings 10 and 11 are provided, which are respectively arranged mirror symmetrically with regard to the dead center plane A–B, two such bores 30 and 31, respectively 32 and 33 are provided for each of the control openings.

A connecting bore 34 branches off from the throttle bore 30 and this connecting bore extends inclined to the front face of the valve plate and communicates with the bearing pocket 27. Corresponding connecting bores 35, 36 and 37 are also provided for the throttle bores 31, 32 and 33 and the connecting bores 35 – 37 respectively communicate with the bearing pockets 28, 29 and 26.

As evident from the drawing, the connection of each control opening with the bearing pockets coordinated therewith is provided by only two bores which extend inclined with respect to each other.

Figures 3A, 3B:
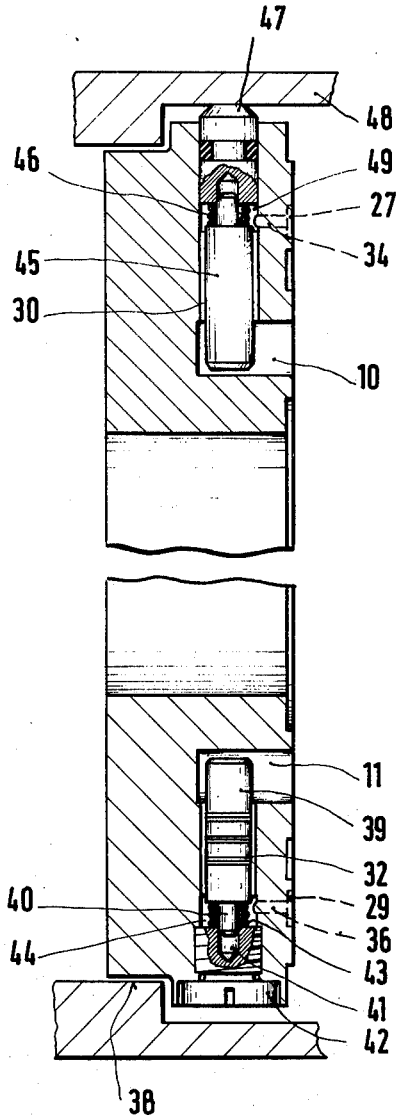
FIG. 3A is a partial cross-section taken along the line III—III of FIG. 1 showing one embodiment.
FIG. 3B is a partial cross-section taken along the aforementioned line and showing another embodiment.

FIGS. 3A and 3B respectively illustrate the arrangement of the throttle pins in the corresponding throttle bores.

As shown in FIG. 3A a throttle pin 45 is arranged in the throttle bore 30, projecting with a radially inner end into the corresponding control opening 10. The throttle pin 45 is biased by means of a spring 46 in radially inward direction. The spring 46 abuts with its radially inner end against a shoulder of the throttle pin 45 and with its radially outer end against a pin 47 which in turn abuts with an outer end against a portion of a housing 48 surrounding the valve plate. In this way any relative movements between the valve plate and the housing 48 are transmitted to the throttle pin 45. An annular space 49 is provided in the region of the spring 46 and a connecting bore 34 extending inclined to the control face of the valve plate communicates at one end with the aforementioned annular space 49 and at the other end with the bearing pocket 27. The operating pressure prevailing in the control opening 10 is transmitted through the clearance between the throttle pin 45 and the throttle bore 30 so that a small amount of liquid will pass through this clearance into the annular space 49 under considerable loss of pressure. The small amount of liquid passing into the annular space 49 flows from there through the connecting bore 34 into the bearing pocket 27 to build in the latter a hydrostatic bearing. The same will occur in the region of the other throttle pins and bearing pockets so that in this way the valve plate will be hydrostatically mounted on the rotating cylinder drum.

FIG. 3B illustrates a modified arrangement in which the throttle bore 32 extends from the periphery 38 of the valve plate into the control opening 11. A throttle pin 39 is located with small annular clearance in the throttle bore 32. The outer end 40 of the throttle pin 39, which is of reduced diameter, is oscillatingly arranged in a blind bore 41 of a threaded closure member 42, screwed into the outer, radially slightly enlarged, end of the throttle bore 32. A spring 43 is arranged about the portion 40 of reduced diameter of the throttle pin 39, abutting with opposite ends respectively against the shoulder of the throttle pin and the inner face of the closure member 42. An annular chamber 44 is provided in the region of the spring 43, and a connecting bore 36, extending inclined to the control face of the valve plate, communicates at opposite ends with the annular chamber 44 and the bearing pocket 29. It is to be understood that corresponding arrangements are provided for each of the bearing pockets formed in the control face of the valve plate to thus provide a plurality of hydrostatic bearings.

It will be understood that each of the elements described above, or two or more together, may also find a useful application in other types of valve plate, differing from the types described above.

While the invention has been illustrated and described as embodied in a valve plate for use in an axial piston machine of the swash plate type, in which the valve plate is provided on its control face with a plurality of shallow pockets, forming hydrostatic bearings, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an axial piston machine of the swash plate type, a combination comprising a valve plate having a front face and a rear face, a pair of control openings in said front face and each having opposite ends; a plurality of bores providing communication between said opposite ends of said control openings and said rear face of said valve plate; a plurality of shallow pockets in said front face respectively forming hydrostatic bearings; a plurality of throttle bores having outer ends at the periphery of said valve plate and each communicating at an inner end with a respective control opening; a throttle pin arranged with small clearance in each of said throttle bores for oscillating movement; biasing means for each throttle pin for biasing the same in one direction of its oscillation; a housing surrounding said peripheral surface of said valve plate; closure means for closing the outer ends of each throttle bore, each of said closure means comprising a pin in the outer end of the respective throttle bore and having an outer end abutting onto a portion of said housing; and a plurality of connecting bores through said valve plate respectively providing communication between said pockets and said throttle bores in the region of the outer ends of the latter.

2. A combination as defined in claim 1, each of said biasing means comprising a compression spring abutting with opposite ends respectively on the respective closure means and the respective throttle pin.

3. A combination as defined in claim 1, wherein said biasing means are springs, each having a spring characteristic so that each of said throttle pins will carry out an oscillating movement during operation of the machine due to variations of fluid pressure acting on the throttle pins.

4. A combination as defined in claim 1, wherein the pressure loss of the fluid passing from said control openings to said pockets is substantially 50% of the operational fluid pressure at a selected optimal height of a gap at the front face of the valve plate.

5. A combination as defined in claim 1, wherein each of said throttle bores extends in radial direction of said valve plate.

6. A combination as defined in claim 1, wherein for each control opening two throttle bores are provided each of which is connected by a connecting bore to a pocket.

7. A combination as defined in claim 6, wherein said control openings are arranged mirror-symmetrically to a first plane, and wherein said pockets are arranged radially outwardly of said control openings and mirror-symmetrically to said first plane as well as to a second plane normal to said first plane.

* * * * *